United States Patent [19]

Newton et al.

[11] Patent Number: 4,504,296

[45] Date of Patent: Mar. 12, 1985

[54] DOUBLE MIXED REFRIGERANT LIQUEFACTION PROCESS FOR NATURAL GAS

[75] Inventors: Charles L. Newton, Bethlehem; Wayne G. Stuber, Whitehall, both of Pa.

[73] Assignee: Air Products and Chemicals, Inc., Allentown, Pa.

[21] Appl. No.: 515,091

[22] Filed: Jul. 18, 1983

[51] Int. Cl.[3] ..... F25J 1/02; F25J 3/02

[52] U.S. Cl. ..... 62/31; 62/34; 62/40

[58] Field of Search ..... 62/335, 9, 11, 40, 23, 62/24, 29, 30, 31, 27, 28, 34

[56] References Cited

U.S. PATENT DOCUMENTS

| | | | |
|---|---|---|---|
| 3,763,658 | 10/1973 | Gaumer et al. | 62/40 |
| 4,094,655 | 6/1978 | Krieger | 62/40 |
| 4,112,700 | 9/1978 | Forg | 62/28 |
| 4,181,174 | 1/1980 | Grenier | 165/180 |
| 4,229,195 | 10/1980 | Forg | 62/23 |
| 4,274,849 | 6/1981 | Garier | 62/9 |
| 4,339,253 | 7/1982 | Caetani | 62/40 |

*Primary Examiner*—Frank Sever

*Attorney, Agent, or Firm*—Geoffrey L. Chase; E. Eugene Innis; James C. Simmons

[57] ABSTRACT

A process and system are set forth for precooling, liquefying and subcooling a methane-rich feed stream, such as natural gas, with two closed circuit multicomponent refrigerant cycles in which the first refrigerant comprises a binary mixture of propane and butane in a flash refrigeration cycle and the second refrigerant comprises a mixture of nitrogen, methane, ethane, propane and butane in a subcool refrigeration cycle. The first refrigerant preferably cools the feed stream in a plate and fin heat exchanger.

15 Claims, 1 Drawing Figure

DOUBLE MIXED REFRIGERANT LIQUEFACTION PROCESS FOR NATURAL GAS

TECHNICAL FIELD

The present invention is directed to the liquefaction of methane-rich streams, such as natural gas. The invention is more specifically directed to a process and system for the liquefaction of natural gas using two separate refrigeration cycles, both of which contain mixed refrigerant components.

BACKGROUND OF THE PRIOR ART

Natural gas constitutes an extremely clean burning and efficient source of fuel for many industrial and consumer requirements. However, many sources of natural gas are located remotely from their potential end use sites. Although natural gas is an efficient readily utilizable fuel, it is uneconomic to transport it over great distances because of its gaseous state under ambient conditions. This transportation problem is particularly acute when natural gas must be transported from a remote production site across any substantial body of water before being delivered to its end use site. Exemplary of this is the transportation of natural gas by ship across an ocean. It is uneconomical to transport gaseous natural gas under such conditions. Storage of large quantities of natural gas is also uneconomical when it is in its gaseous state.

However, when natural gas is cooled to liquefaction in order to produce a denser unit of natural gas, it has been found that transportation in a nonpipelined mode can be made more economical. Traditionally, the liquefaction of natural gas for storage and transportation is performed in a system which utilizes a refrigerant cycle or several refrigerant cycles in which the natural gas is cooled and liquefied by heat exchange with such refrigerants. The prior art has taught that natural gas may be precooled against one refrigeration cycle, while being liquefied and subcooled against a subsequent refrigeration cycle which is operated at a lower temperature than the precooled refrigerant cycle.

U.S. Pat. No. 3,763,658 is exemplary of such a natural gas liquefaction cycle. This patent discloses the use of a single component propane refrigeration cycle to precool natural gas and a second multicomponent refrigeration cycle to liquefy and subcool the natural gas. The second low temperature refrigeration cycle is also cooled against the first single component precooled refrigeration cycle.

In U.S. Pat. No. 4,112,700 a liquefaction process is set forth which utilizes a first multicomponent refrigerant comprising 20% ethane and 80% propane and a second multicomponent refrigerant comprising nitrogen, methane, ethane and propane. This patent liquefies the vapor phase first refrigerant against the liquid phase first refrigerant in the same heat exchange which is used to precool the natural gas feed to the process.

U.S. Pat. No. 4,181,174 describes a liquefaction process which utilizes a single component first refrigeration cycle (propane), a multicomponent second refrigeration cycle (methane, ethane, propane and butane) and optionally a third multicomponent refrigeration cycle (methane and butane). Natural gas is cooled and liquefied against the refrigerants in a plate-type heat exchanger.

In U.S. Pat. No. 4,274,849, a process is set forth wherein a gas is liquefied against a main refrigerant of methane, ethane and a substance having a boiling point substantially lower than the methane hydrocarbon. A second auxiliary refrigerating cycle is used to cool the main refrigeration cycle but does not cool the liquefying gas in direct heat exchange. This second refrigeration cycle comprises a two component mixture selected from methane, ethane, propane or butane. Unsaturated or branched forms of the hydrocarbons may also be utilized.

U.S. Pat. No. 4,229,195 discloses a process for the liquefaction of natural gas using a first refrigerant of ethane and propane and a second refrigerant of nitrogen, methane, ethane and propane. The natural gas feed to the process is split into several streams prior to eventual liquefaction.

U.S. Pat. No. 4,339,253 discloses a process for liquefying a gas using two refrigeration cycles in a subcooling heat exchange circuit. Compression requirements are reduced by phase separation and pumping and compressing of the respective liquid and gaseous phases. Each refrigerant can be a multicomponent refrigerant.

As energy requirements become more stringent for the liquefaction of natural gas at its production site in order to render it transportable to an end use site, the liquefaction process and apparatus must necessarily become more efficient in liquefying natural gas. The use of various refrigerant combinations has been attempted by the prior art in order to achieve the goal of liquefaction of natural gas in an efficient manner in a process and system requiring the smallest capital outlay and lowest expenditure of energy possible. In order to maintain natural gas as a competitive fuel, all of these criteria for the processing of natural gas are important. The present invention achieves these objectives of providing an efficient liquefaction scheme which has reduced capital requirements and simplified apparatus and maintenance features.

BRIEF SUMMARY OF THE INVENTION

The present invention is directed to a process for precooling, liquefying and subcooling a methane-rich feed stream, such as natural gas, using two closed circuit, multicomponent refrigeration cycles wherein a superatmospheric feed stream is precooled against a first multicomponent refrigerant comprising a binary mixture of propane and butane in a heat exchanger which provides co-current flow of the refrigerant without substantial backmixing of the liquid phase and the vapor phase of the refrigerant. The precooled feed stream is cooled and liquefied against a second multicomponent refrigerant comprising nitrogen, methane, ethane, propane and butane. The liquefied feed stream is then subcooled against the second multicomponent refrigerant before being reduced in pressure to recover a vapor fuel gas stream and a liquid natural gas product of LNG. After cooling the feed stream, the first multicomponent refrigerant is recompressed to a pressure which is high enough to effect total condensation of the refrigerant with ambient water in an aftercooler-condenser. The refrigerant is aftercooled and separated into a refrigerant sidestream and a remaining refrigerant stream, the latter of which is reduced in pressure to a relatively high level cooling temperature by flashing in order to precool the feed stream before being recycled. The refrigerant sidestream is also reduced in pressure by flashing and it is separated into a second refrigerant sidestream and a second remaining refrigerant stream which is flashed to an intermediate temperature level and further precools the feed stream before being recycled. The second sidestream is reduced in pressure by flashing to provide the low level temperature precooling of the feed stream before being recycled for recompression. This is a flash refrigeration cycle in which reduced temperature is achieved by flash pressure reduction without heat exchange of the refrigerant against itself. The second multicomponent refrigerant is compressed to a pressure in the range of approximately 550 to 850 psia and aftercooled against external cooling fluid and further against the first multicomponent refrigerant. The second multicomponent refrigerant is cooled against itself and is reduced in pressure in order to provide the low temperature cooling of the feed stream necessary to liquefy and subcool the feed stream before the refrigerant is recycled for recompression. This is a subcool refrigeration cycle using refrigerant intracooling and flashing to reduce the refrigerant temperature.

Preferably, the first multicomponent refrigerant and the second multicomponent refrigerant are recompressed in stages.

Preferably, the fuel gas stream is warmed against a portion of the second multicomponent refrigerant in order to recover refrigeration potential from the fuel gas.

Optionally, the first multicomponent refrigerant flows downwardly through a plate and fin heat exchanger in multiple stages in order to precool the methane-rich or natural gas feed stream.

The present invention is also directed to a system or apparatus for the precooling, liquefying and subcooling of a methane-rich feed stream using two closed circuit, multicomponent refrigeration cycles. The system comprises a multistage plate and fin heat exchanger supplied with different temperature levels of a first multicomponent refrigerant and having passageways for precooling a methane-rich feed stream against said refrigerant wherein said refrigerant comprises a binary mixture of propane and butane in which the heat exchanger allows for co-current flow of the refrigerant phases without substantial backmixing of the liquid phase with the vapor phase, a second multistage heat exchanger for liquefying and subcooling the precooled methane-rich feed stream against a second multicomponent refrigerant comprising nitrogen, methane, ethane, propane and butane, a separator vessel for separating a vapor phase fuel gas from the liquid phase methane-rich stream from said second heat exchanger after said stream is reduced in pressure, means for conveying the liquid methane-rich stream to storage or export, a multistage compressor for compressing the first multicomponent refrigerant, an aftercooler for reducing the temperature of said compressed first multicomponent refrigerant to an initial low temperature, means for flashing and conveying separate streams of said first multicomponent refrigerant at different reduced temperatures to said multistage heat exchanger for precooling the feed stream in stages, means for recycling the warmed and vaporized first multicomponent refrigerant to said multistage compressor, a compressor for compressing the second multicomponent refrigerant, means for conveying the compressed second multicomponent refrigerant through an aftercooler and the precool heat exchanger in order to cool said second refrigerant, a separator vessel for separating said second multicomponent refrigerant into a vapor phase and a liquid phase, means for separately conveying the phases of the second multicomponent refrigerant to said second multistage heat exchanger in order to subcool the refrigerant against a portion of itself and to liquefy and subcool the methane-rich feed stream, and means for recycling the warmed second multicomponent refrigerant to the compressor.

Preferably the means for conveying separate streams of first multicomponent refrigerant comprises three separate feeds to the plate and fin heat exchanger.

Preferably, the apparatus includes a heat exchanger for recovering refrigeration from the fuel gas stream by the vapor phase of the second multicomponent refrigerant.

DETAILED DESCRIPTION OF THE INVENTION

Figure 1:
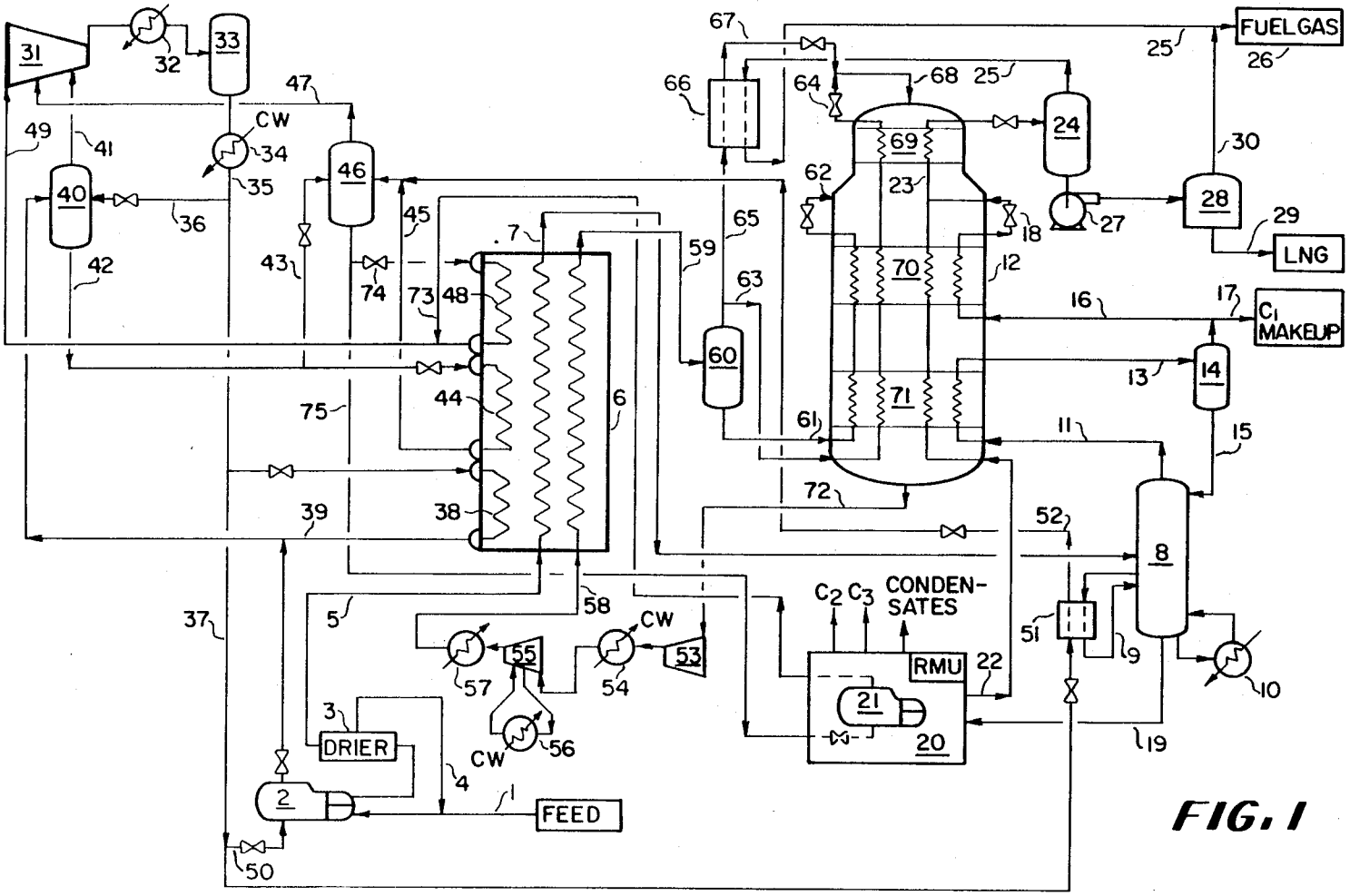
FIG. 1 shows a schematic representation of the flow scheme of the present invention.

In the production of LNG in a two refrigeration cycle liquefaction process, it has been deemed desirable to shift refrigeration load between the precool refrigeration cycle and the low temperature subsequent refrigeration cycle which performs the actual liquefaction and subcooling of the feed gas. Refrigeration loads have been shifted from the precool cycle where a single component refrigerant such as propane has been used, to the low temperature or subsequent refrigerant cycle in order to balance the compression loads and more specifically the compression apparatus of the overall system. This minimizes the amount of different parts required for the operation and maintenance of the equipment. In shifting refrigeration load from the precool cycle a power efficiency loss is experienced. Using mixed refrigerant in the precool cycle allows a level of freedom in making refrigeration load adjustments so as to minimize or avoid power efficiency losses. The present invention shows unexpectedly that a refrigerant component heavier than propane, namely butane, is beneficial when used in a mixture with propane in the precool refrigeration cycle. However, the use of mixed refrigerants in the precool cycle is not without problems. In vaporizing the liquid refrigerant during heat exchange with the feed stream to be cooled, the increased concentration of the heavier component in the vaporization stage must be avoided in order to prevent variations in the temperature of the heat exchanger where the vaporization of the refrigeration is taking place. Therefore, the traditional kettle reboiler type shell heat exchangers which are utilizable for single component refrigerants are not efficient for the use with a binary refrigerant mixture, such as the propane and butane precool refrigerant of the present invention. For this invention, it has been found that a plate and fin heat exchanger, in which the multicomponent vaporizing refrigerant in the heat exchanger flows in a co-current manner to avoid substantial backmixing of liquid phase refrigerant with vapor phase refrigerant, is essential to the adequate performance of the process. Preferably, the precool mixed refrigerant would flow downwardly through such a plate and fin heat exchanger during the precooling of the feed stream such that the liquid refrigerant would descend with the vaporized refrigerant in a uniformly mixed refrigerant flow. This avoids unacceptable increases in temperature which would be brought about by excessive concentration of the heavy component in the mixed refrigerant in localized areas. Such an effect would take place in a kettle reboiler where all of the boiling liquid is mixed and boils essentially at constant temperature, i.e. the dew point of the refrigerant mixture.

In downward two phase refrigerant flow, no backmixing of liquid refrigerant can occur. However, in upward flow, which may be advantageous to design for, the liquid phase of the refrigerant can potentially settle back due to the force of gravity and result in backmixing of warmer liquid, more concentrated with butane, with colder liquid which is less concentrated with butane. The amount of liquid which is allowed to settle back and backmix influences the T-H (temperature-enthalpy) curve of the warming refrigerant causing the warming curve to more closely approach the cooling stream curve. The largest amount of backmixing can occur at the inlet for each boiling refrigerant heat exchanger stage. At the inlet there is the least amount of vapor to lift the liquid, whereas, as boiling progresses within the exchanger, additional vapor is generated to lift the liquid with more gravity counteracting force. By limiting the flow area of the boiling refrigerant exchanger passages, the liquid lifting force may be increased. The lifting force must be controlled by proper exchanger design to avoid substantial liquid backmixing. The design should limit the approach of the warming and cooling T-H curves, preferably, to within 1° to 3° F. temperature difference, or at least limit the approach to a small fraction of a degree F. Keeping the equipment design and process operation within these limitations avoids substantial backmixing of the liquid phase refrigerant with the vapor phase refrigerant.

The unique binary refrigerant of the present invention has been found to provide significant improved refrigeration efficiency when operated in a flash refrigeration cycle as contrasted with a subcool refrigeration cycle. The flash cycle of the present invention consists of the method and apparatus necessary to cycle the refrigerant to various individual temperature and pressure levels of heat exchange or stages in cooling the feed stream by the use of valves which rapidly reduce the pressure on the compressed or high pressure refrigerant, thus cooling the refrigerant. The valves are situated in each feed line of the refrigerant to the individual stages of the precool heat exchanger. This allows for efficient and specific cooling of that portion of the refrigerant necessary for the particular heat exchanger stage. The combination of the binary propane/butane precool refrigerant in such a flash refrigeration cycle has been shown to be particularly efficient for providing refrigeration and to the provision of a degree of freedom in designing the driver loads for the overall LNG plant.

The flash cycle uses rapid pressure reduction or flashing, but does not heat exchange against another portion of the same refrigerant to achieve the desired low temperature. The flash cycle is contrasted with a subcool cycle which can use both pressure reduction and heat exchange against another portion of the same refrigerant to obtain the desired low temperature.

The present invention will now be described in greater detail with reference to FIG. 1. A methane-rich feed stream comprising natural gas having a composition of approximately 96% methane, 1.8% ethane, 1% nitrogen, 0.6% propane and residual higher hydrocarbons is supplied at 630 psia at approximately 72° F. in line 1. The feed stream is initially cooled in a heat exchanger 2 against a sidestream of the precool refrigerant in order to condense the major portion of any entrained water prior to drying in the dryer apparatus 3. The dryer 3 may consist of switching adsorbent beds or other known systems for removing the remaining vaporous moisture from a gas stream. In order to reactivate the switching bed apparatus, which is preferred, a reactivation gas recycle stream is reintroduced into the feed stream through line 4. The dried feed stream in line 5 is then introduced into a multistage plate and fin heat exchanger 6 wherein the feed stream is cooled in its passageways with a progressive series of three stages 38, 44 and 48 against high, medium and low temperature and pressure level precool or first multicomponent refrigerant in a flash refrigeration cycle. The precool refrigerant comprises a binary mixture of propane and butane. The propane consists of approximately 86% of the refrigerant while the remaining 14% is butane. The feed stream is cooled against the precool refrigerant in the first stage of the heat exchanger 6 at a high level temperature of 5° C. The feed stream is cooled against the second stage of the precool refrigerant in the heat exchanger 6 at an intermediate level temperature of −7° C. The feed stream is then cooled against precool refrigerant at a low level temperature of −24° C. which effects a final temperature in the progressive temperature reduction of the feed stream emanating from the heat exchanger 6 in line 7 of −22° C. The exchanger has passageways designed to provide downward co-current flow of liquid and vapor phase refrigerant without backmixing of the liquid into the vapor phase.

The feed stream in line 7 is then introduced into a scrub column 8 in order to effect the separation of a predominantly methane vapor phase 11 of the feed stream and a higher hydrocarbon containing liquid phase 19 of the feed stream. The scrub column is operated by the reboil 10 of the bottom of the column against external heating fluid, the heat exchange of a sidestream 9 from the scrub column 8 in a heat exchanger 51 operated with a portion of the sidestream 37 of the precool refrigerant and finally by the reflux of a portion of the vapor phase 11 of the feed stream returned to the scrub column in line 15 after cooling against a second refrigerant.

The vapor phase feed stream in line 11 is introduced into a second multistage heat exchanger comprising a three bundle 69, 70 and 71 coil wound heat exchanger 12 which is operated with a second multicomponent refrigerant. The second multicomponent refrigerant is comprised of approximately 52% ethane, 38.5% methane, 4.4% propane, 3% butane and 1.7% nitrogen. The vapor phase feed stream in line 11 is initially cooled in heat exchange against this second refrigeration cycle in the warm bundle 71 of the coil wound heat exchanger 12. The feed stream is then removed in line 13 and phase separated in separator vessel 14. The liquid phase is returned in line 15 as reflux for the scrub column 8. The vapor phase is removed in line 16 and a portion of the vapor phase may be removed in line 17 for the methane component of the refrigeration makeup for the second refrigeration cycle. The remaining feed stream in line 16 is then reintroduced into the heat exchanger 12 in the intermediate temperature level bundle 70. The feed stream is liquefied in this bundle and is then reduced in pressure through valve 18 before being reintroduced into the heat exchanger 12.

The liquid phase of the feed stream from the scrub column 8 is removed in line 19. This stream contains higher hydrocarbons such as ethane, propane and higher alkyl hydrocarbons. A portion of these higher hydrocarbons are removed from the liquid phase of the feed stream in a distillative separation using distillation apparatus 20 which is operated by a heat exchanger 21 driven by a portion of the precool refrigeration cycle. Ethane, propane and higher alkyl hydrocarbon condensates are removed from the liquid phase of the feed stream in this distillation separation. Makeup refrigerant for the first and second refrigeration cycles may be removed from this distillation apparatus. The residual liquid phase feed stream in line 22 is cooled as a liquid in the coil wound heat exchanger 12 in the first or warm bundle 71 and the intermediate bundle 70 before being combined with the originally vapor phase feed stream in line 16. Both streams in the liquid phase in line 23 are then subcooled by further heat exchange in the low temperature third bundle 69 before being removed from the heat exchanger 12. The liquefied and subcooled feed stream is reduced in pressure and introduced into a separator vessel 24. A fuel gas is removed as a vapor phase fraction in line 25 while the predominant amount of the feed stream is removed as a liquid phase and pumped in pump 27 to storage in containment vessel 28. The liquefied product as LNG can be removed for export or use in any means, such as line 29. The fuel gas in line 25 is warmed in heat exchanger 66 against a vapor phase portion of the second refrigerant in order to recover the refrigeration from the fuel gas. The fuel gas can then be combined with vapor from the storage of the LNG in vessel 28, this vapor being removed in line 30. The combined vaporized fuel gas stream can be removed in line 26. The fuel gas can be used to power the LNG plant.

The propane and butane multicomponent first refrigerant in the precool flash refrigeration cycle is compressed in a multistage compressor 31 to a high pressure in the range of approximately 75 to 250 psia. Preferably, the compressor comprises three stages of compression. The warm, compressed precool refrigerant is aftercooled and totally condensed in an aftercooler or heat exchanger 32 against an external cooling fluid source, such as cooling water. This first multicomponent refrigerant is then delivered to a supply reservoir 33. The first multicomponent refrigerant is then subcooled in a heat exchanger 34 similar to heat exchanger 32. The subcooled first multicomponent refrigerant now in line 35 is separated into a refrigerant sidestream 36 and a remaining refrigerant stream still in line 35. The remaining refrigerant stream is reduced in pressure by flashing it through a valve in order to further cool the refrigerant which is then passed through the first or warm stage (high level) 38 of the plate and fin heat exchanger 6 in order to initially precool the methane-rich feed stream as well as the second multicomponent refrigerant, before the precool refrigerant is returned for compression in line 39. The refrigerant in line 39 has been revaporized and is supplied to separator vessel 40.

The sidestream of the first multicomponent refrigerant in line 36 is reduced in pressure by flashing through a valve and is also supplied to separator vessel 40. The vapor phase refrigerant cools the remaining liquid phase before the vapor is returned for recompression in line 41. The liquid phase refrigerant, now further cooled, is supplied through line 42 to the heat exchanger 6. A second refrigerant sidestream is removed in line 43 and a resulting second remaining refrigerant stream is reduced in pressure by flashing through a valve in line 42 and supplied to the intermediate stage 44 of the heat exchanger 6. This refrigerant is introduced into the heat exchanger at approximately −7° C. (intermediate level) and further cools the methane-rich feed stream and the second multicomponent refrigerant in the heat exchanger before being at least partially revaporized and returned for recompression in line 45.

The second refrigerant sidestream in line 43 is reduced in pressure by flashing through a valve to cool the refrigerant and is then supplied to separator vessel 46. The vapor phase refrigerant in this vessel 46 is returned for recompression in line 47. The liquid phase refrigerant in vessel 46 is removed from the base of the vessel 46 and a portion of the refrigerant is reduced in pressure by flashing through a valve 74 before being introduced into the cold (low level) or final stage 48 of the heat exchanger 6 at approximately −24° C. This refrigerant is at the lowest pressure of the precool cycle and performs the final precooling of the methane-rich feed stream, as well as the second multicomponent refrigerant. The methane-rich feed stream emanates from this heat exchanger 6 at −22° C. The warmed and totally vaporized refrigerant from the cold stage 48 is recycled in line 49 for recompression in compressor 31. A portion of the refrigerant in line 35 is removed in line 37 for refrigeration duty in the initial heat exchanger 2 by use of a sidestream of the refrigerant from line 37 in line 50. The remaining portion of the refrigerant in line 37 is used to reboil the scrub column 8 by means of heat exchange in heat exchanger 51. The refrigerant is then returned and combined with refrigerant in line 45 through line 52. A portion of the refrigerant in the liquid phase from vessel 46 is also diverted to the distillation apparatus 20 for duty in the heat exchanger 21 before being returned to the refrigerant flow in line 49 by way of line 73.

The second multicomponent refrigerant comprising approximately 52% ethane, 38.5% methane, 4.4% propane, 3% butane and 1.7% nitrogen is compressed and aftercooled in stages through compressor 53, aftercooler or heat exchanger 54 supplied with an external cooling fluid such as water, compressor 55 and aftercooling heat exchangers 56 and 57 which operate in a manner similar to exchanger 54. The refrigerant is compressed to a high pressure in the range of approximately 450 to 850 psia. The second multicomponent refrigerant is additionally aftercooled in stages in the first heat exchanger 6 in line 58 against the first multicomponent refrigerant. The second multicomponent refrigerant exits the heat exchanger 6 at −22° C. in line 59. The second multicomponent refrigerant is phase separated in a separator vessel 60. The liquid phase of the second multicomponent refrigerant is delivered to the heat exchanger 12 in line 61 and is cooled against itself in the warm and intermediate bundles 71 and 70 before being reduced in pressure and introduced into the shell of the heat exchanger through line 62 in the form of a spray of the refrigerant which descends down over the warm and intermediate bundles cooling and liquefying the methane-rich feed stream. The vapor phase of the second multicomponent refrigerant from vessel 60 is split into a sidestream 63 and a remaining stream 65. The sidestream 63 is cooled, against a portion of the same refrigerant, in bundle 71, 70 and the cold bundle 69 before being removed from the heat exchanger 12 and reduced in pressure through valve 64. The remaining stream in line 65 is cooled in heat exchanger 66 against fuel gas in line 25 being removed from the liquefaction product. The cooled remaining refrigerant stream in line 67 is reduced in pressure and combined with the stream in line 64. The combined stream is then introduced into the top of the heat exchanger 12 in line 68 as a spray which descends over the cold bundle 69, the intermediate bundle 70 and the warm bundle 71 cooling the methane-rich feed stream and liquefying and subcooling the stream in a series of staged heat exchanges. The vaporized second multicomponent refrigerant is removed from the base of the heat exchanger 12 in line 72 for recompression.

The described process provides a unique and efficient method and apparatus for the liquefaction of natural gas, particularly where it is desired to shift refrigeration load onto the precool refrigeration cycle from the second refrigeration cycle. Normally the driver loads for the compressors of the precool and second refrigeration cycles are balanced with one number of compressors for precool refrigerant and another number of compressors for the low level multicomponent subcooled refrigerant. At times, the LNG plant may require a different number of drivers or the ambient conditions experienced at an LNG plant situated in a cold climate may result in an inbalance of compressor load such that the load does not match the capacity of a given number of compressor drivers. When an application requires similar driver loads, such as to reduce the amount of dissimilar equipment (compressor drivers), the required shift of refrigeration load to match equipment forces the suction pressure of the refrigeration cycle upward making the cycle, in this case the precool cycle, less efficient. The alteration of the precool cycle from a single component refrigerant to a mixed component refrigerant of propane and butane has provided a significant level of process efficiency by bringing the suction pressure back down to near ambient, while allowing the matching of driver load and driver equipment for the refrigeration cycles. In comparison against a propane precool refrigerant-multicomponent subcool refrigerant overall LNG plant cycle, the propane-butane flash precool cycle was found to be 2.7% more power efficient and had the capability of increasing production by 3.5%. The individual propane-butane precool cycle, isolated, showed a savings of approximately 2,500 horsepower or 9.9% over the prior art propane precool cycle.

The propane-butane precool cycle, when used in an LNG plant with a multicomponent subcool refrigerant cycle, has been shown to provide efficiencies over a propane precool-multicomponent subcool LNG plant, as well as a multicomponent precool-multicomponent subcool LNG plant as described in U.S. Pat. No. 4,274,849. The improvement is documented in Table 1 below.

TABLE 1

| | Present Invention | Propane Precool Cycle* | Multicomponent Cycle** |
|---|---|---|---|
| Total Power HP | 68528 | 70430 | 78438 |
| Efficiency of Invention over Prior Art | — | 2.7% | 12.6% |

*U.S. Pat. No. 3,763,658
**U.S. Pat. No. 4,274,849

The use of butane as a component of a precool refrigerant cycle provides a unique capacity to reduce the required refrigerant flow in the precool cycle due to the higher latent heat of vaporization of the butane component. This combined with a lower specific heat ratio results in a lower compression power and an ability to reduce the precool compressor suction pressure. Suction pressure on the compressor of the precool cycle in a typical propane refrigerant system goes up when an attempt is made to balance load between precool and subcool cycles by shifting load from the precool system. Suction pressure substantially above atmospheric pressure drops efficiency of the refrigerant cycle. The addition of butane to the propane precool cycle of an LNG plant drops the suction pressure to the compressor back down to approximately above the atmospheric pressure and efficient operation without changing the desired temperature of the precool cycle. In using a heavy component such as butane in the precool cycle, it is necessary to avoid the localized change in refrigerant composition. The use of heat exchange apparatus wherein the precool refrigerant mixture is forced to flow co-currently without substantial backmixing of the liquid portion of the refrigerant with the initially vaporizing portion of the refrigerant is necessary in order to maintain the minimum refrigeration temperature desired in the heat exchanger. A component as heavy as butane when utilized with propane will have a tendency to remain liquid, while the propane will tend to vaporize more quickly than the butane. Therefore, within the individual stages of the heat exchanger, a possibility exists with such a mixed refrigerant of having a localized change in the composition of the refrigerant which is adsorbing heat from the cooling feed stream. An increased proportion of butane will provide a greater amount of heat adsorption due to the change in the refrigerant composition, and this allows the temperature in an individual bundle to potentially rise, rather than remaining steady under a state of continuous vaporization. The present invention, by using a heat exchanger with co-current flow and preferably a downward flow of refrigerant through the heat exchanger, avoids this potential drawback to the use of mixed refrigerant, and specifically, butane in the precool cycle.

Optimally, the invention is practiced with a plate and fin heat exchanger wherein the refrigerant flows downwardly co-currently through the passages of the exchanger in order to avoid an increased concentration of butane due to backmixing or accumulative boiling. This provides a unique operating capacity for the liquefaction scheme of the present invention, in that the precool refrigerant composition of propane and butane allows for a greater degree of adjustment of the cycle to the particular liquefaction circumstances and particularly to the equalization of compressor loads between cycles. Normally, the equilization of compression loads creates an inefficiency in the precool cycle, which is difficult to eliminate with known precool refrigerants.

The present invention has been described with respect to a specific embodiment. However, it is contemplated that those skilled in the art could make obvious changes in the invention without departing from the scope thereof which should be ascertained by the claims which follow.

We claim:

1. A process for precooling, liquefying and subcooling a methane-rich feed stream using two closed circuit, multicomponent refrigeration cycles comprising:

(a) precooling a gaseous superatmospheric methane-rich feed stream against a first multicomponent refrigerant comprising a binary mixture of propane and butane in proportions preselected to increase the overall efficiency of said process in a flash, staged refrigeration cycle which substantially avoids backmixing of refrigerant;

(b) liquefying the methane-rich stream in heat exchange against a second multicomponent refrigerant;

(c) subcooling the methane-rich stream in heat exchange against the second multicomponent refrigerant;

(d) compressing said first multicomponent refrigerant to a high pressure and aftercooling and condensing the compressed refrigerant against an external cooling fluid;

(e) flashing the first refrigerant to a lower pressure and temperature in order to cool the feed stream against the refrigerant in a series of staged heat exchanges;

(f) compressing the second multicomponent refrigerant to a high pressure and aftercooling the same against an external cooling fluid; and (g) further cooling the second multicomponent refrigerant against the first multicomponent refrigerant before liquefying and subcooling the feed stream against the refrigerant in a series of staged heat exchanges.

2. The process of claim 1 wherein the first multicomponent refrigerant precools the methane-rich feed stream in a heat exchanger which provides co-current flow of the refrigerant phases without substantial backmixing of the liquid phase refrigerant with the vaporized refrigerant.

3. The process of claim 2 wherein the refrigerant stream passes downwardly through a multistage plate and fin heat exchanger.

4. A process for precooling, liquefying and subcooling a methane-rich feed stream using two closed circuit, multicomponent refrigeration cycles comprising:

(a) precooling a gaseous superatmospheric methane-rich feed stream against a first multicomponent refrigerant comprising a binary mixture of propane and butane in portions selected to increase the overall efficiency of said process in a progressive series of heat exchanges in a first heat exchanger which provides cocurrent flow of the refrigerant phases without substantial backmixing of the liquid phase of the refrigerant with the vapor phase of the refrigerant wherein the refrigerant is cooled in a flash refrigeration cycle wherein the refrigerant is flashed to progressively lower temperatures and pressures;

(b) liquefying the precooled methane-rich stream in an initial heat exchange in a second heat exchanger against a second multicomponent refrigerant comprising nitrogen, methane, ethane, propane and butane wherein the refrigerant is cooled in a subcool refrigeration cycle by pressure reduction and heat exchange against itself;

(c) subcooling the liquefied methane-rich stream in further heat exchange against the second multicomponent refrigerant in which the refrigerant has been cooled in a subcool refrigeration cycle;

(d) compressing said first multicomponent refrigerant to a pressure in the range of 75 to 250 psia and aftercooling the compressed refrigerant against an external cooling fluid;

(e) separating said first multicomponent refrigerant into a refrigerant sidestream and a remaining refrigerant stream which is reduced in pressure by flashing and which precools the methane-rich feed stream in said heat exchanger to a first relatively high temperature level before being recycled for recompression;

(f) reducing the pressure by flashing on the refrigerant sidestream and separating it into a vapor phase which is recycled to recompression and a liquid phase refrigerant;

(g) separating said liquid phase refrigerant of step (f) into a second refrigerant sidestream and a second remaining refrigerant stream which is reduced in pressure by flashing and further precools the methane-rich feed stream to an intermediate temperature level in said heat exchanger before being recycled for recompression;

(h) reducing the pressure by flashing on the second refrigerant sidestream and separating it into a vapor phase which is recycled to recompression and a liquid phase refrigerant;

(i) further reducing the pressure by flashing on the liquid phase refrigerant of the second sidestream and precooling the methane-rich feed stream to a low temperature level in said heat exchanger before recycling the refrigerant to recompression;

(j) compressing the second multicomponent refrigerant of step (b) to a pressure in the range of 450 to 850 psia and aftercooling the same against an external cooling fluid;

(k) further cooling the second multicomponent refrigerant against the first multicomponent refrigerant in said first heat exchanger; and (l) reducing the pressure on the second multicomponent refrigerant and heat exchanging the refrigerant against a portion of itself to cool it before passing it in heat exchange communication against the methane-rich feed stream to liquefy and subcool the latter and then recycling the refrigerant for recompression.

5. The process of claim 4 wherein the first multicomponent refrigerant is compressed in stages.

6. The process of claim 5 wherein the second multicomponent refrigerant is compressed in multiple stages with interstage cooling of the refrigerant between the stages of compression.

7. The process of claim 4 wherein the first multicomponent refrigerant precools the methane-rich feed stream in a plate-fin heat exchanger.

8. The process of claim 7 wherein the first multicomponent refrigerant flows downwardly through the plate-fin heat exchanger.

9. The process of claim 4 wherein the subcooled methane-rich stream of step (c) is reduced in pressure to separate a vapor phase as fuel gas and a liquid phase as methane-rich product.

10. The process of claim 9 wherein the fuel gas is warmed against second multicomponent refrigerant.

11. The process of claim 9 wherein the fuel gas is used to provide power for the liquefaction process.

12. A system for precooling, liquefying and subcooling a methane-rich feed stream using two closed circuit, multicomponent refrigeration cycles comprising:

(a) a multistage plate and fin heat exchanger having elements designed, sized and arranged for receiving different temperature levels of a first multicomponent refrigerant and having passageways for precooling a methane-rich feed stream against said refrigerant wherein said refrigerant comprises a binary mixture of propane and butane in which the heat exchanger allows for cocurrent flow of the refrigerant phases without substantial backmixing of the liquid phase with the vapor phase;

(b) a second multistage heat exchanger for liquefying and subcooling the methane-rich feed stream against a second multicomponent refrigerant;

(c) means for conveying the liquid methane-rich stream to storage or export;

(d) a multistage compressor for compressing the first multicomponent refrigerant to a pressure of 75 to 250 psia;

(e) an aftercooler for reducing the temperature of said compressed first multicomponent refrigerant to an initial lower temperature;

(f) means for conveying and flashing separate streams of said first multicomponent refrigerant at different reduced temperatures to said multistage plate and fin heat exchanger for precooling the feed stream in stages;

(g) means for recycling the warmed and vaporized first multicomponent refrigerant to said multistage compressor of clause (d);

(h) a compressor for compressing the second multicomponent refrigerant to a pressure in the range of 450 to 850 psia;

(i) means for conveying the compressed second multicomponent refrigerant through an aftercooler and the plate and fin heat exchanger in order to cool said refrigerant in stages;

(j) a separator vessel for separating said second multicomponent refrigerant into a vapor phase and a liquid phase;

(k) means for separately conveying the phases of the second multicomponent refrigerant to said second multistage heat exchanger of clause (b) in order to cool the refrigerant against a portion of itself and to liquefy and subcool the methane-rich feed stream; and (l) means for recycling the warmed second multicomponent refrigerant to the compressor of clause (h).

13. The system of claim 12 wherein the means for conveying separate streams of first multicomponent refrigerant comprises three separate feeds to said heat exchanger.

14. The system of claim 12 including a separator vessel for separating a vapor phase fuel gas from the liquid phase methane-rich stream from said second heat exchanger after said stream is reduced in pressure.

15. The system of claim 14 including a heat exchanger for recovering refrigeration from the fuel gas stream by the vapor phase of the second multicomponent.

* * * * *